United States Patent [19]

Korzelius

[11] 4,355,483

[45] Oct. 26, 1982

[54] SWITCH MECHANISM

[75] Inventor: Donald G. Korzelius, Darien, N.Y.

[73] Assignee: The Quaker Oats Company, Chicago, Ill.

[21] Appl. No.: 222,583

[22] Filed: Jan. 5, 1981

[51] Int. Cl.[3] ..... A63H 33/26; H01H 3/12

[52] U.S. Cl. ..... 46/232; 200/159 B; 200/159 R; 200/292; 200/5 A

[58] Field of Search ..... 200/159 A, 159 B, 159 R, 200/292, 340, 5 A; 46/174, 232

[56] References Cited

U.S. PATENT DOCUMENTS

| | | | |
|---|---|---|---|
| 3,699,294 | 10/1972 | Sudduth | 200/292 |
| 3,796,843 | 3/1974 | Durkee et al. | 200/159 B |
| 4,066,860 | 1/1978 | Kawasaki | 200/159 B |
| 4,156,120 | 5/1979 | Vaerlien et al. | 200/340 |
| 4,231,098 | 10/1980 | Tanimoto | 200/5 A |

*Primary Examiner*—John W. Shepperd

*Attorney, Agent, or Firm*—Cumpston & Shaw

[57] ABSTRACT

A switch mechanism for use in an electronic toy having a printed circuit board, a portion of which has a pattern of printed wiring with contacts thereon. A body of conductive resilient material, disposed in the housing of the toy with the printed circuit board, has a base portion with an opening therein. Part of the base is a bridge across the opening, having a push button and a web flexurably connecting the push button to the base. The body is disposed in juxtaposition with the board portion over the contacts with the push button extending through an opening in the housing to present an end of the button which, when depressed, causes a connection to be made between the board contacts through the conductive material of the body for operating the electronic circuits of the toy. A plurality of push buttons may similarly be disposed as part of individual bridges on the base for operating different circuits of the toy when depressed.

11 Claims, 6 Drawing Figures

SWITCH MECHANISM

DESCRIPTION

1. Field of the Invention

The present invention relates to an improved switch mechanism and particularly to an improved push button switch mechanism.

The invention is especially suitable for use in electronic toys for making connections to selectively operate the circuits thereof. The invention also has applications in other apparatus, where push button switches are needed.

2. Background of the Invention

Applications for push button switches exist in numerous electrical and electronic apparatus. Switch mechanisms for electrically operated toys present unique problems in that they must not only be effective but simple in design and low in cost. They must also be easy to install and replace.

Conductive resilient material is an especially desirable switching medium and has been used in switch mechanisms (see U.S. Pat. No. 3,789,167, issued Jan. 29, 1974). The design of such switch mechanisms is excessively complex and costly such as to militate against the use of conductive resilient material in many applications, particularly for electrical and electronic toys.

SUMMARY OF THE INVENTION

It is an object of the present invention to provide an improved switch mechanism.

It is another object of the present invention to provide an improved push button switch mechanism.

It is a still further object of the present invention to provide an improved push button switch mechanism which is especially adapted to be installed in electrical and electronic toys.

It is a still further object of the present invention to provide a simple and effective push button switch mechanism which is low in cost.

It is a still further object of the present invention to provide an improved push button switch mechanism using conductive, resilient material to provide the movable contactor thereof and a printed wiring pattern of a printed circuit board to provide the fixed contacts thereof.

Briefly described, a switch mechanism embodying the invention makes use of a body of resilient, electrically conductive material having a base with an opening therein and a bridge across the opening and integral with the base. The base is preferably rectilinear and four-legged. A push button having webs, flexurally connecting the push button to opposite legs of the base, constitutes the bridge. The push button extends through an opening in a wall, which may be part of the housing of an electrical or electronically operated toy. A member, such as a printed circuit board, containing the circuits of the toy, has electrical contacts thereon. The body is disposed between the wall and the board with the base and push button in alignment with different ones of a plurality of contacts extending from the wiring on the board. To make a connection the push button is depressed and reciprocated to make and break a connection through the conductive material of the body between the board contacts. The body and board are not physically attached to each other. Spacers in the housing hold the body and the board in juxtaposition so that the switch mechanism may easily be assembled.

BRIEF DESCRIPTION OF THE DRAWINGS

The foregoing and other objects features and advantages of the invention as well as a presently preferred embodiment thereof will become more apparent from a reading of the following description in connection with the accompanying drawings in which.

DETAILED DESCRIPTION

Figure 1:
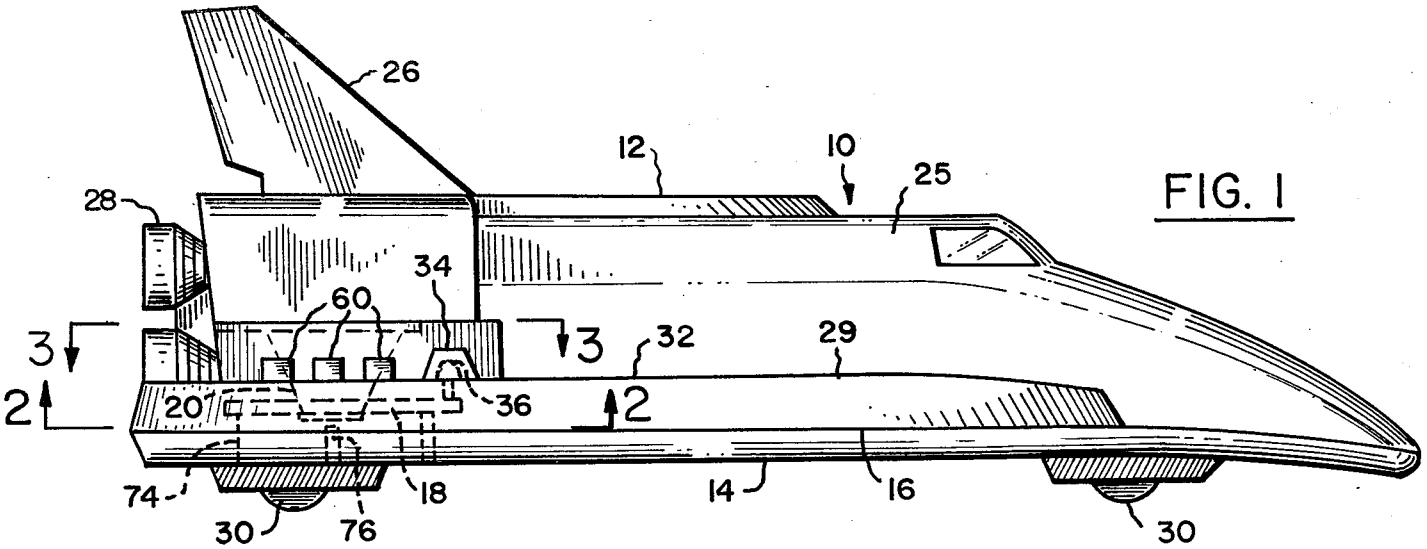
FIG. 1 is a side view of a rocket ship toy in which a push button mechanism embodying the invention is disposed, showing generally the location of the push button mechanism in the toy.
Figure 2:
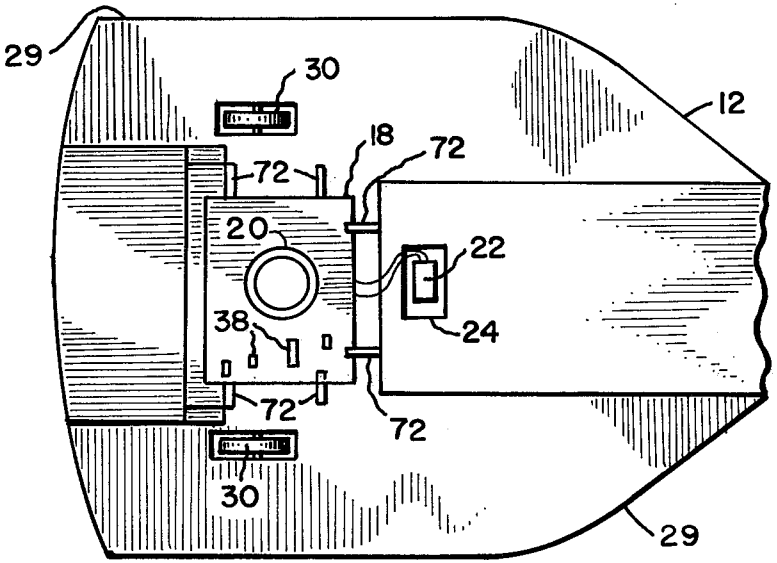
FIG. 2 is a fragmentary plan view of the toy disassembled, the view being taken generally along the line 2—2 in FIG. 1.

Referring to the drawings, there is shown a rocket ship toy 10 having a housing with upper and lower parts 12 and 14 which are separable from each other along an interface 16. These parts may be of molded plastic material which provides shells enclosing an internal structure. So far as significant to the present invention this internal structure comprises a printed circuit board 18 having a loud speaker 20 mounted thereon. The printed circuit board contains electrical and electronic circuitry powered by a battery 22 in a compartment 24 within the housing as shown in FIG. 2.

The exterior of the housing, in the upper part 12 thereof, is in the shape of the fuselage 25, tail 26 and rocket engines 28 of a rocket ship. The lower rear of the upper and lower parts 12 and 14 have the shape of wings of the rocket ship. Wheels 30 are journaled in struts in the lower part 14. The parts 12 and 14 may be assembled by means of screws.

The wall 32 of the upper part 12, which forms one of the wings 29, has transparent or translucent coverings or lenses 34 for light emitting diode lamps 36 which are connected to the printed circuit board 18. Mounted on the board, with the loudspeaker 20, are electronic components 38 such as resistors, capacitors, transistors and integrated circuits which, with the printed wiring on the board, provide electronic effects for the toy 10.

Figure 5:
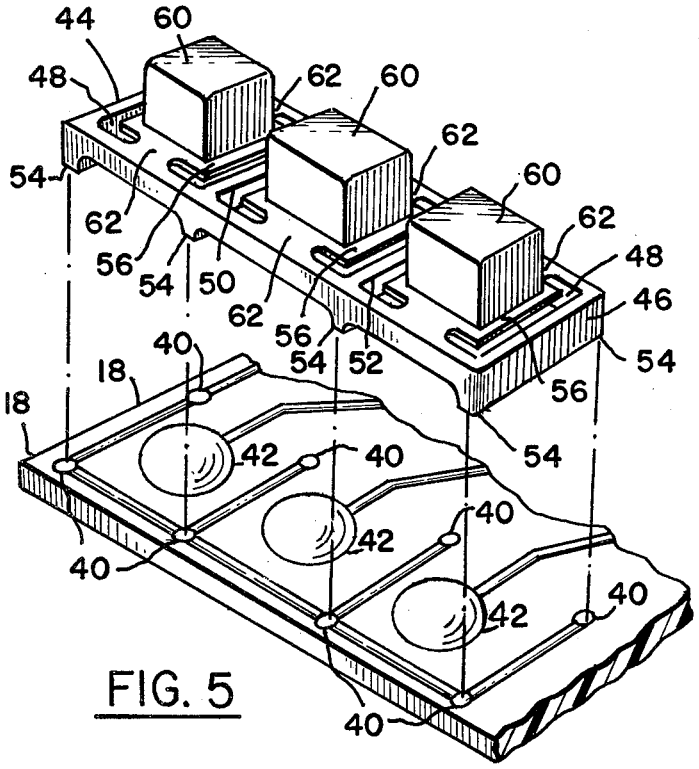
FIG. 5 is an exploded view in perspective showing a fragment of the printed circuit board and the body of flexible conductive material which together provide the push button switch mechanism which is shown in FIGS. 1 through 4.
Figure 6:
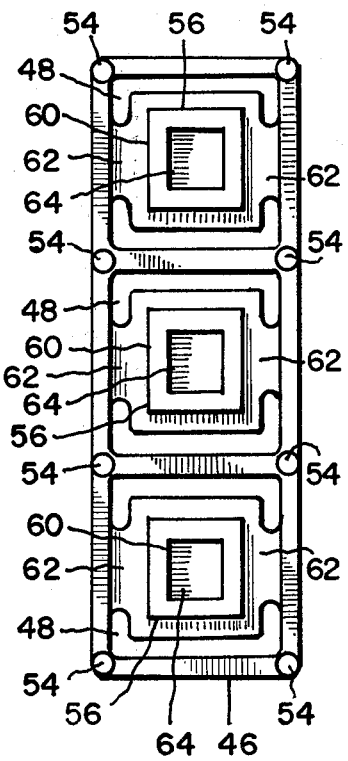
FIG. 6 is a view of the body of flexible conductive material taken from the bottom.

The printed circuit board has a printed wiring pattern thereon which interconnects the loudspeaker 20, the components 38 and the leads from the battery 22. A portion of this pattern is shown in FIG. 5. This portion has three sets of conductive pads 40 and 42 which provide contacts. The pads may be buttons of solder. The pads 40 are arranged at the corners of adjacent squares while the pads 42 are larger in diameter than the pads 40 and are in the center of each of the squares. These contact sets cooperate with a push button contactor 44 which is best shown in FIGS. 5 and 6. The contactor 44 and the sets of contacts 40 and 42 provide a switch mechanism for operating the electronic circuits of the toy which circuits are contained on the printed circuit board 18. These circuits may generate signals for different sound effects. The signals are translated into sounds by the loudspeaker 20 to enhance the enjoyment of the toy. Other effects which are controlled by the switch mechanism may include the selective illumination of the lamps 36.

Contactor 44 is a body of resilient, conductive plastic material such as a thermoplastic elastomer with a conductive filler, as for example, carbon black. Silicone rubber filled with conductive particles may also be used. The contactor is molded as an integral body, in one piece. The body has a base 46 which is rectilinear with side and cross legs, and has three four-legged sections, each with an opening 48 therein. Two of the cross legs 50 and 52 are common to adjacent ones of the opening. The base 46 has feet 54 at the intersection of the legs, as can best be observed in FIG. 6. When the contactor 44 is disposed upon the printed circuit board 18, the legs 54 are aligned with and seated upon the corner contacts 40.

Separate bridges 56 extend between opposite legs across the openings 48. These bridges have push button portions 60 and flexural webs 62 connected to opposite legs of the base 46. The push buttons are square in cross section. The push buttons may be molded with blind holes 64. When the base 46 juxtaposed on the printed circuit board 18 with the feet 54 in alignment with the corner contacts 40, the lower ends of the push buttons 60 are in alignment and registry with the contacts 42. These contacts 42 have a diameter larger than that of the blind holes 64 so as to enable contact to be made with the push buttons 60.

Figure 3:
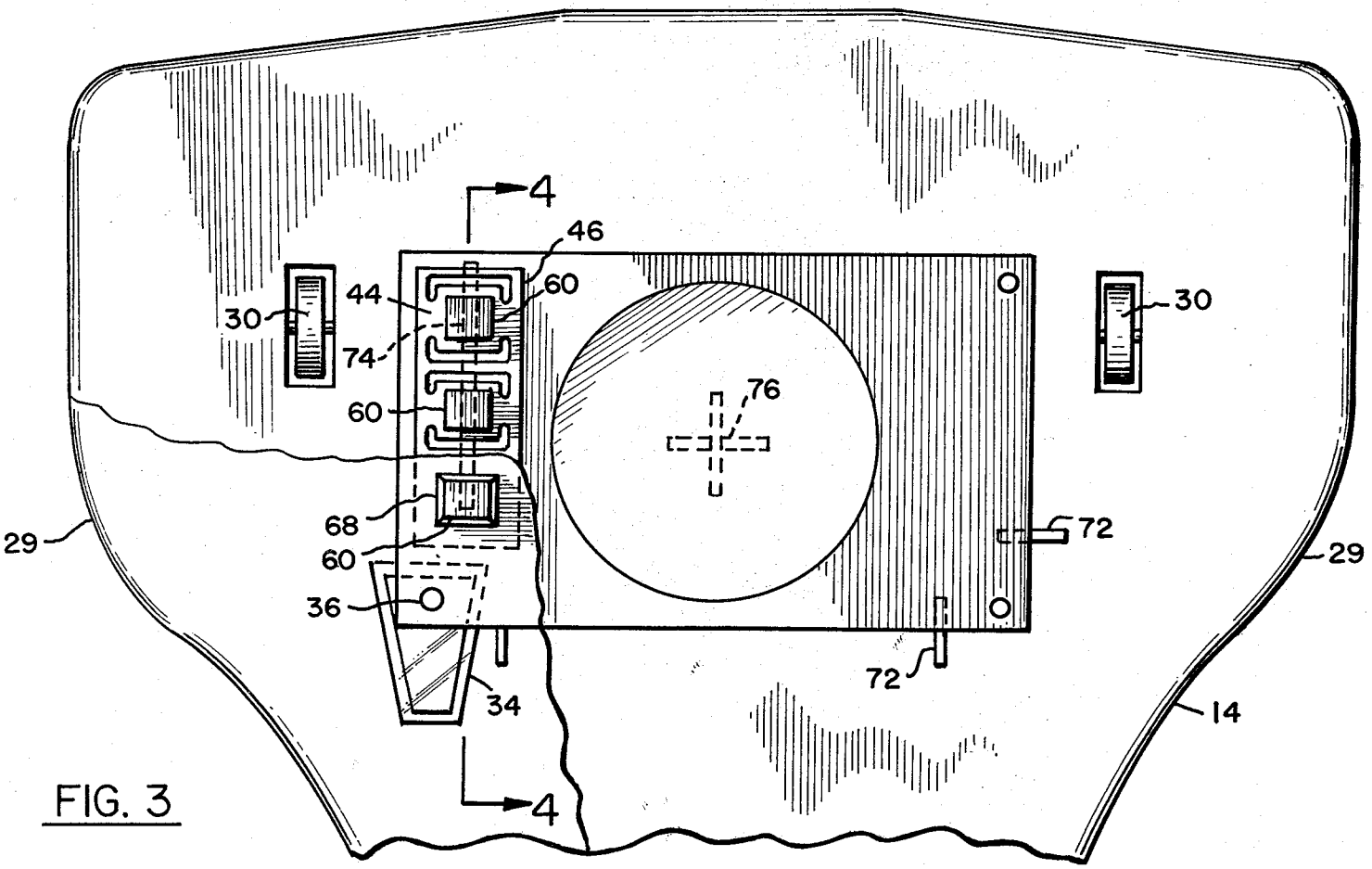
FIG. 3 is another fragmentary plan view of the toy shown in FIG. 1, taken generally along the line 3—3 in FIG. 1.
Figure 4:
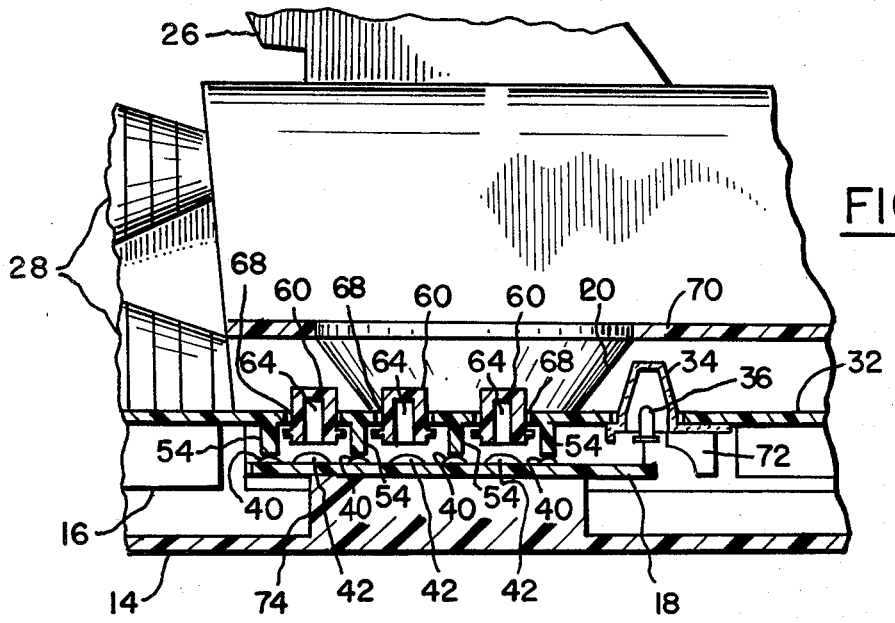
FIG. 4 is a fragmentary sectional view through the push button mechanism which is taken along the line 4—4 in FIG. 3.

The wall 32 of one of the wings 29, as is shown best in FIGS. 3 and 4, has three apertures or openings 68. These openings are square in shape. The contactor 44 is placed on the wall with the square push button 60 in the openings. The board 18 is then placed in the housing upon the contactor 44. The feet 54 are in alignment with the contacts 40 on the board 18, and the lower end of the push button 60 in alignment with the center contact 42. The position of the board is determined by a spacer 70 in the upper portion 12 against which the loudspeaker rim 20 bears. Tabs 72 locate the edges of the board 18. When the board is so located, the lamps 36 enter into the lenses 34. A flange 74 on the bottom part 14 of the housing bears against the board under the region thereof where the contacts 40 and 42 are disposed. Also a cross-shaped spacer 76 is positioned beneath the bottom of the board through which the loudspeaker 20 projects to limit the deflection of board under a heavy load as might occur if the toy were dropped. Spacer 74 bears against the board, when the lower part 14 and the upper part 12 of the housing are assembled, and locates the board 18 and the actuator 44 with respect to each other. The assembly is made merely by dropping the contactor 44 and the board 18 in place. There is no need to attach the contactor to the board. This makes the assembly simple and convenient.

When an electronic circuit function is desired one or more of the push buttons 60 is pressed. The depressed push button then reciprocates through the opening 48 in the base and contacts the center contact 40. The conductive material of the contactor 44 selectively makes and breaks a connection between the contacts 42 and the contacts 40. When such contact is made the electronic circuits are operative to provide the selected sound effects or functions. When the push buttons are released the flexural web restores the push buttons to the position where the connection is broken at the center contacts 42. Accordingly a simple and effective push button mechanism is provided.

From the foregoing description it will be apparent that there has been provided an improved switch mechanism which is especially adapted for use with electrical or electronic toys. Variations and modifications of the herein described switch mechanism, within the scope of the invention, will undoubtedly suggest themselves to those skilled in the arts. For example, the shape of the base 46 may vary from a rectilinear shape and yet provide the necessary openings and support for the bridges containing the flexurally mounted push buttons. Accordingly the foregoing description should be taken as illustrative and not in a limiting sense.

I claim:

1. A switch mechanism comprising a body of resilient, electrically conductive material having a base with an opening therein and a bridge across said opening, said bridge having a push button portion and webs flexurally connecting said push button portion to said base for reciprocal movement when pushed, a wall having an aperture therein, a member having a plurality of fixed electrical contacts thereon, said body being disposed between said wall and said member with said push button projecting through said aperture, means for positioning said base and push button in alignment with said member and with different ones of said plurality of contacts to make a connection there between when said button is pressed and to break said connection when said button is released.

2. The switch mechanism as set forth in claim 1 wherein said body is of a molded, conductive rubber-like material.

3. The switch mechanism as set forth in claim 1 wherein said base is rectilinear and four-legged, said bridge extending between two of said legs which are opposite to each other.

4. The switch mechanism as set forth in claim 3 wherein said base of said body is rectangular in shape having side legs and a plurality of cross legs perpendicular thereto at the ends and intermediate the ends of said side legs, a plurality of said openings through said base between said side legs and cross legs, separate bridges between opposite legs across each of said openings, each of said bridges having a separate push button and webs flexurally connecting said push buttons to said opposite legs, a plurality of openings in said wall, said push buttons projecting through said wall openings, and separate contacts on said member, each in alignment with a different one of said push buttons to make contact therewith.

5. The switch mechanism as set forth in claims 1 or 4 wherein said member is a printed circuit board having a pattern of printed wiring with pads of conductive material projecting therefrom to provide said contacts.

6. The switch mechanism as set forth in claim 5 wherein said base member has raised feet at the intersections of said legs, said feet being disposed in juxtaposition, each with a different one of said contacts pads.

7. The switch mechanism as set forth in claim 1 further comprising means for providing a compartment having a pair of opposed walls including said wall which encloses said member and said body, and spacer means on at least one of said walls against which said member bears.

8. The switch mechanism as set forth in claim 7 wherein said member is a printed circuit board and further comprising tabs on at least one of said pairs of walls against which the edges of said board bear.

9. For use in an electronic toy having a housing and a printed circuit board having electronic circuitry thereon in said housing, a push button switch mechanism comprising a body of resilient, conductive materials having a base portion, a bridge suspended on said base portion, said bridge having a push button and a flexural web integral with said base portion, means positioning said base adjacent a portion of said board in juxtaposition on one side thereof, said board having printed wiring with conductive pads in contact with said base portion and in alignment with and spaced from said push button, said housing having an opening through which said push button projects to present an end thereof which can be pressed to make contact with the pad which is disposed in alignment therewith.

10. The invention as set forth in claim 9 wherein said body and board are loosely disposed in said housing, spacer means in said housing for locating said board and said push button, and said housing opening being rectilinear in shape to locate said body in registry with said board and said contact pads thereon.

11. The invention as set forth in claim 10 wherein said board has a loudspeaker mounted thereon, said spacer means including an apertured plate and a flange, said apertured plate and flange being disposed on opposite sides of said board with said loudspeaker and board bearing thereon to locate said board and body in registry with each other in said housing.

* * * * *